US006857297B1

(12) United States Patent
Ruan

(10) Patent No.: US 6,857,297 B1
(45) Date of Patent: Feb. 22, 2005

(54) LOCK ENHANCING DEVICE

(75) Inventor: JiaQiang Ruan, Kowloon (HK)

(73) Assignee: Path Line (ng's) Holding Limited, Kowloon (HK)

( * ) Notice: Subject to any disclaimer, the term of this patent is extended or adjusted under 35 U.S.C. 154(b) by 0 days.

(21) Appl. No.: 10/696,943

(22) Filed: Oct. 29, 2003

(51) Int. Cl.[7] ..... E05B 65/06

(52) U.S. Cl. ..... 70/134; 70/129; 70/224; 70/370; 292/336.3; 292/337; 292/1.5

(58) Field of Search ..... 70/134, 224, 448, 70/451, 416–418, 452, 466; 292/336.3, 337, 346, DIG. 55, 51

(56) References Cited

U.S. PATENT DOCUMENTS 1,661,454 A * 3/1928 Wilson ..... 70/448
1,829,815 A * 11/1931 Schlage ..... 292/337
2,732,239 A * 1/1956 Wilson ..... 292/169.22
3,961,508 A * 6/1976 Crepinsek ..... 70/370
3,992,908 A * 11/1976 Crepinsek ..... 70/370
4,073,172 A * 2/1978 Schlage ..... 70/417
4,272,974 A * 6/1981 Hennessy ..... 70/129
4,643,007 A * 2/1987 Fish et al. ..... 70/134
4,890,871 A * 1/1990 Lin ..... 292/337
5,074,605 A * 12/1991 Fann et al. ..... 292/337
5,094,486 A * 3/1992 Foster ..... 292/167
5,722,273 A * 3/1998 Lin et al. ..... 70/370
5,906,125 A * 5/1999 Shen ..... 70/370
6,334,635 B1 * 1/2002 Huang ..... 292/1.5
6,502,436 B2 * 1/2003 Beatty ..... 70/134
6,553,799 B2 * 4/2003 Bates et al. ..... 70/224
6,722,716 B2 * 4/2004 Baser ..... 292/336.3
2003/0041633 A1 * 3/2003 Britz et al. ..... 70/134
2003/0131640 A1 * 7/2003 Eller et al. ..... 70/224

* cited by examiner

*Primary Examiner*—Suzanne Dino Barrett
(74) *Attorney, Agent, or Firm*—Raymond Y. Chan; David and Raymond

(57) ABSTRACT

A lock for locking a door panel to a door frame, which includes a knob assembly comprising a front protective housing and a rear knob frame defining a lock cavity therebetween in the door panel; a door latch assembly including a latch actuation member transversely disposed within the lock cavity and a locking latch connected to the latch actuation member in a slidably movable manner; an actuation unit to actuate the door latch assembly; and a lock enhancing device which includes a reinforcing member for substantially mounting to the door panel between the front and the rear side thereof, and a latch guider integrally extended from the reinforcing member within the lock cavity to couple with an inner end portion of the latch actuation member so as to substantially retain the latch actuation member within the lock cavity in position.

9 Claims, 5 Drawing Sheets

LOCK ENHANCING DEVICE

BACKGROUND OF THE PRESENT INVENTION

1. Field of Invention

The present invention relates to locks, and more particularly to a lock enhancing device which is arranged to reinforce the strength of conventional locks so as to prevent them from being easily damaged, thus failure to provide sound security.

2. Description of Related Arts

A wide variety of locks have been widely used for security purposes. A conventional door lock which is incorporated in a door usually comprises an actuation unit which has a key slot formed therein, a knob assembly comprising a front protective housing and a rear knob frame attached on a front and a rear side of a door panel respectively wherein the actuation unit is mounted in the front protective housing in a rotatably movable manner, and a locking latch mounted between the front protective housing and the rear knob frame in such a manner that the actuation unit, upon being inserted with a predetermined key, is adapted to drive the locking latch to engage with a door frame by which the door is pivotally supported so that the door panel is locked with respect to the door frame. Conversely, the actuation unit is also adapted to drive the locking latch to disengage with the door frame so that the door panel can be unlocked with respect to the door frame.

As a matter of fact, notwithstanding its popularity, such a conventional door lock has several observable discrepancies. First of all, the very function of the front protective housing is to protect and strengthen the actuation unit so as to prevent it from being easily damaged or destroyed by an unauthorized trespasser. Unfortunately, very often, the front protective housing is not strong enough both in terms of the materials used and its structure so that an intentional trespasser, by strongly twisting the actuation unit or vigorously breaking the front protective housing, can be able to destroy the door lock and open the door. Even though the front protective housing is not broken altogether by the external force, such a substantial impact may have caused considerable distortion to it which then becomes extremely vulnerable to future damages.

Second, the connection between the front protective housing and the rear knob frames is usually not strong enough so that when a trespasser applies vigorous impact to the door lock, the connection between the first and the rear knob assembly will be broken altogether and, as a result, the front protective housing and the rear knob frame and the actuation unit may detach from the door and leave the door unlocked immediately.

Because of the important objective which a door lock has to achieve, governments in various territories have adopted different standards regulating the sales and quality of locks available in that territory. Among those standards and regulations, in United States of America, ANSI/BHMAA156.5-2001 categorizes an anti-twist ability and an impact resistance of a regular door lock as each having three distinct levels, the median of which are 160 Nm and 100 J respectively. As can be seen from these figures, there exist a very high official standard expected from a qualified door lock, and in respect of this, most conventional door locks fail to achieve the required standard.

Because of the inherent structural features of conventional door locks as mentioned above, a stronger and more secure lock is definitely required.

SUMMARY OF THE PRESENT INVENTION

A main object of the present invention is to provide a door lock comprising a lock enhancing device which is arranged to engage with a door on which the door lock is mounted so as to effectively share the strength of the door to maximize resistibility to over twisting or impact to the knob assembly of the door lock. In other words, the present invention considerably distributes externally applied damaging forces to the door so as to minimize a direct burden of impact borne by the knob assembly.

Another object of the present invention is to provide a door lock which comprises a lock enhancing device comprising a latch guider adapted to transversely bias against a front protective housing and a rear knob frame of the knob assembly so as to resist a damaging transverse or twisting force applied thereto. Moreover, the latch guider helps in distributing externally applied forces to the door.

Another object of the present invention is to provide a door lock wherein the front protective housing comprises a reinforced base in order to effectively resist external damaging force applied to the door lock so as to increase the overall security thereof. Moreover, the front protective housing is also reinforced in term of its structure so as to be capable of substantially preventing a distortion when subjected to the external damaging force.

Another object of the present invention is to provide a door lock which comprises a lock enhancing device comprising a coupling arm rearwardly extended from the actuation unit to connect the front protective housing with the rear knob frame via a door latch assembly sandwiched therebetween so as to increase the connection strength of the door lock of the present invention. In other words, the front protective housing and the rear knob frame are securely connected to resist external damaging twisting forces or impacts.

Another object of the present invention is to provide a door lock comprising a lock enhancing device which does not involve complicated or expensive mechanical components so as to minimize the manufacturing cost and the selling price of the present invention in order that the door lock of the present invention can be widely accepted by public, thus increasing their security awareness.

Another object of the present invention is to provide a door lock comprising a lock enhancing device wherein the door lock is capable of substantially complying the highest standard in the field of security locks as prescribed by major orthodox engineering standards or engineering associations, such as the engineering requirements for locks laid down by the International Organization for Standardization (ISO).

In order to achieve the above objects, the present invention provides a lock for locking a door panel to a door frame, comprising:

a knob assembly comprising a front protective housing and a second knob frame adapted for being mounting on a front and a rear side of the door panel respectively so as to define a lock cavity between the front protective housing and the second knob frame;

a door latch assembly comprising a latch actuation member transversely disposed within the lock cavity and a locking latch connected to the latch actuation member in a slidably movable manner;

an actuation unit mounted to the knob assembly to actuate the locking latch to slidably move between a locked position and an unlocked position, wherein in the locked position, the locking latch is received in the lock cavity for allowing a pivotal movement of the door panel with respect to the door frame, wherein in the unlocked position, the locking latch is slidably and outwardly extended for engaging with the door frame so as to lock up with the door frame; and a lock enhancing device, which comprises:

a reinforcing member for substantially mounting to the door panel between the front and the rear side thereof; and a latch guider integrally extended from the reinforcing member within the lock cavity to couple with an inner end of the latch actuation member so as to substantially retain the latch actuation member within the lock cavity in position, wherein the latch guider is engaged between the first protective housing and the second knob frame so as to block a rotational movement of each of the first protective housing and the second knob frame with respect to the actuation unit.

These and other objectives, features, and advantages of the present invention will become apparent from the following detailed description, the accompanying drawings, and the appended claims.

DETAILED DESCRIPTION OF THE PREFERRED EMBODIMENT

Figure 1:
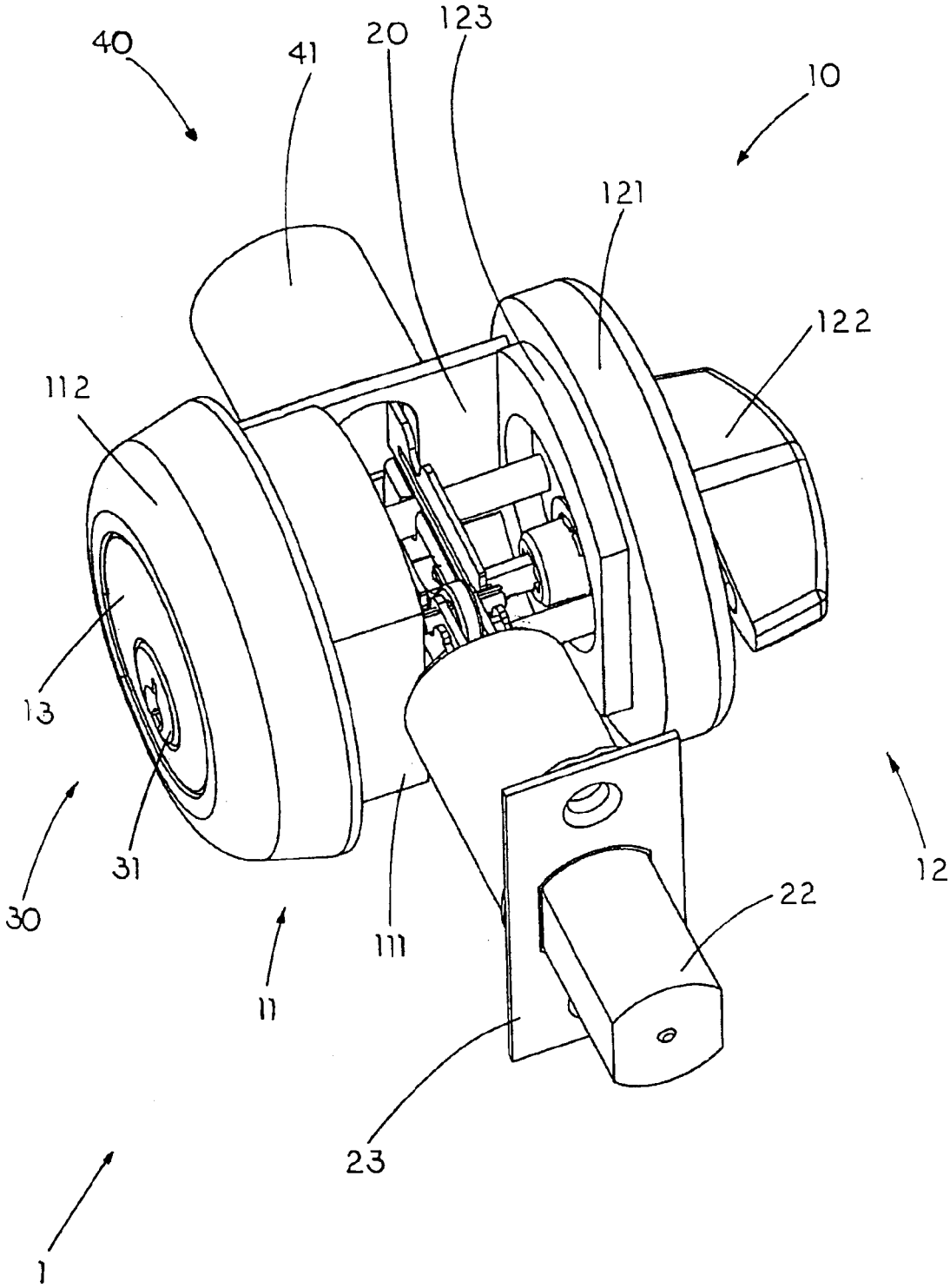
FIG. 1 is a perspective view of a door lock with a lock enhancing device according to a preferred embodiment of the present invention.
Figure 2:
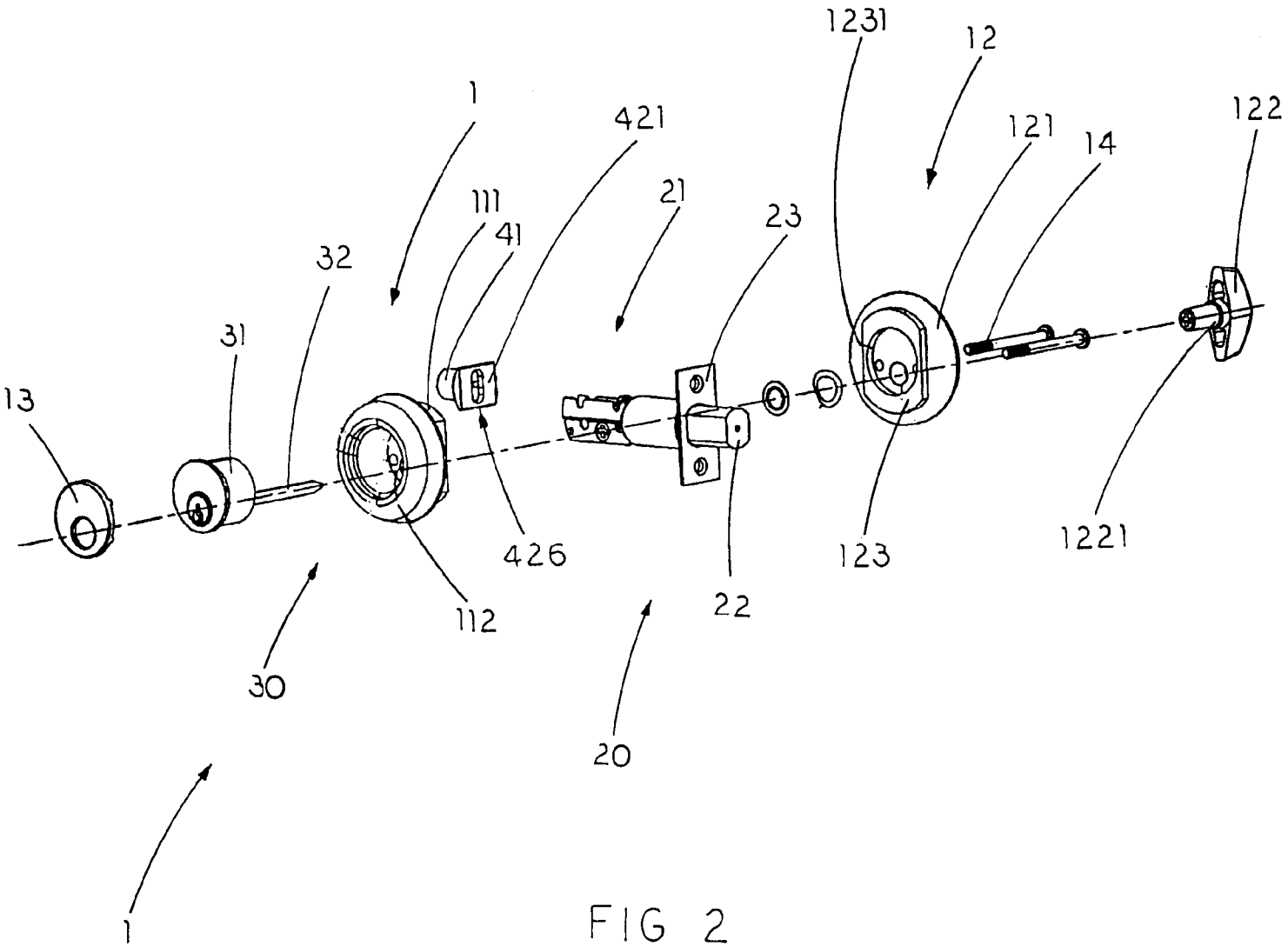
FIG. 2 is an exploded perspective view of a door lock with a lock enhancing device according to the above preferred embodiment of the present invention.

Referring to FIG. 1 and FIG. 2 of the drawings, a lock 1 for locking a door panel to a door frame according to a preferred embodiment of the present invention is illustrated. According to the preferred embodiment, the lock 1 comprises a knob assembly 10, a door latch assembly 20, an actuation unit 30, and a lock enhancing device 40.

The knob assembly 10 comprises a front protective housing 11 and a rear knob frame 12 adapted for being mounted on a front and a rear side of the door panel respectively to form a lock cavity therebetween, wherein the door latch assembly 20, the actuation unit 30 and the lock enhancing device 40 are supported in the lock cavity.

The front protective housing 11, preferably made of metallic materials such as brass, comprises a reinforced base 111 and a side boundary 112 frontwardly and peripherally extended therefrom to define a receiving cavity between the reinforced base 111 and the side boundary 112, wherein the actuation unit 30 is adapted to be mounted in the receiving cavity for actuating the door latch assembly 20.

The side boundary has an exterior shape of a truncated cone having a reinforced thickness which is greater than that of a conventional front protective housing 11 so that it is capable of sustaining a greater impact externally applied thereto without being substantially distorted or damaged. In other words, the geometrical structure is substantially reinforced to sustain damaging impact and twisting applied to the door lock 1. Similarly, the reinforced base 111 is thickened with respect to those of the conventional door locks in order to better resist externally applied forces or impacts to the front protective housing 11. Moreover, the reinforced base 111 is thickened so that it is capable of substantially engaging with the lock enhancing device 40.

Referring to FIG. 2 of the drawings, the knob assembly 10 further comprises a front cover 13 adapted to be mounted on the side boundary 112 in such a manner as to cover the receiving cavity while the actuation unit 30 is mounted in the receiving cavity. The front cover 13 accomplishes additional protection and decoration purposes to the door lock 1 of the present invention.

The rear knob frame 12 comprises a rear doorknob 121 adapted to bias against the rear side of the door panel, and a locking rotor 122 which is rotatably mounted on the rear doorknob 121, and has a driving member 1221 extended to couple with the door latch assembly 20 in such a manner that when the locking rotor 122 is rotated in a predetermined position with respect to the rear doorknob, the door latch assembly is driven to actuate locking or unlocking of the door panel with respect to the doorframe.

The knob assembly 10 further comprises a plurality of connecting members 14 connecting the rear doorknob 121 with the reinforced base 111 of the front protective housing 11 through a plurality of connecting holes formed on the rear doorknob 121 and the reinforcing base 111 respectively.

Figure 5:
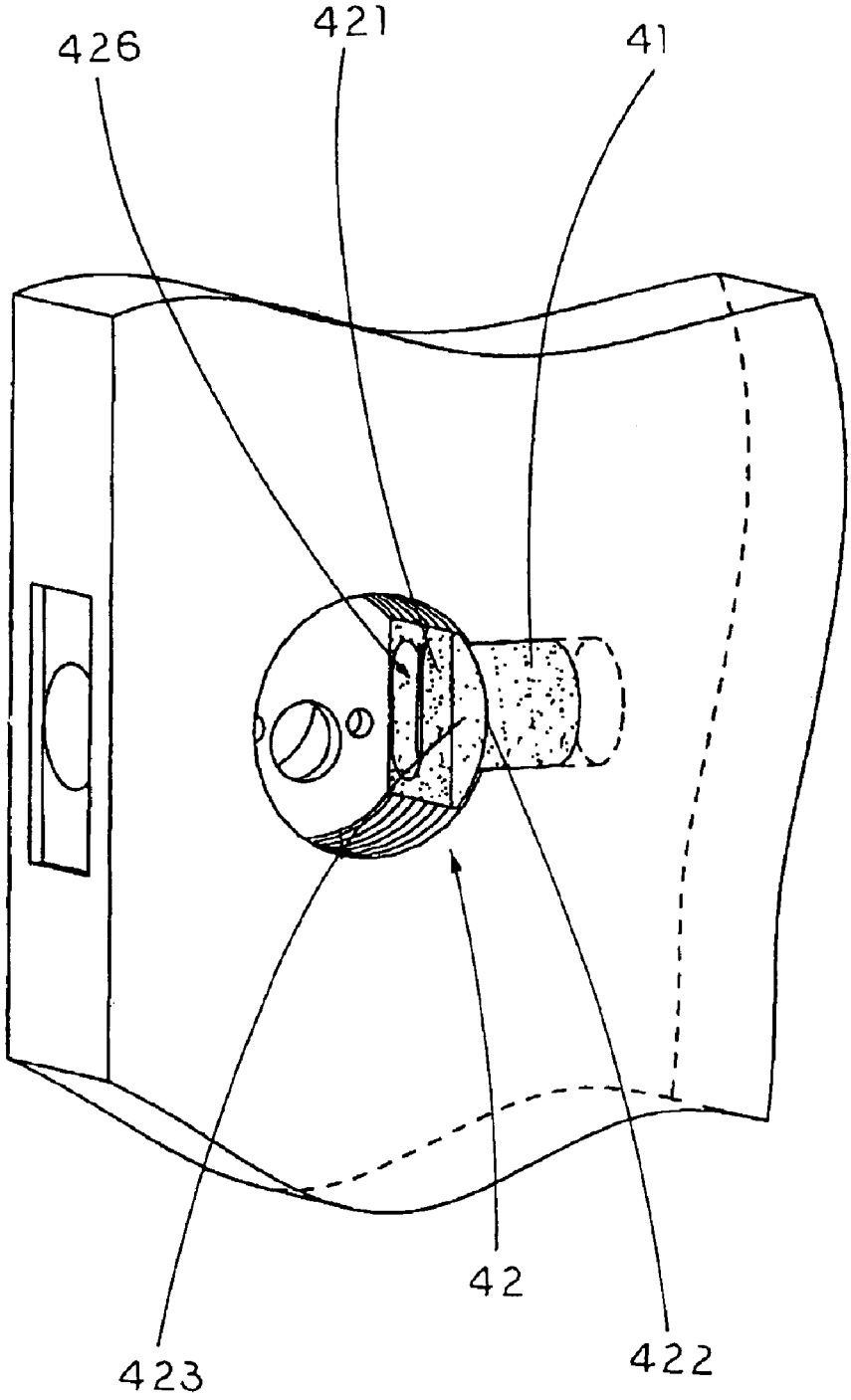
FIG. 5 is a schematic diagram of the lock enhancing device according to the above preferred embodiment of the present invention, illustrating that the lock enhancing device is mounted on a door panel.

Referring to FIG. 2 and FIG. 5 of the drawings, the door latch assembly 20 comprises a latch actuation member 21 transversely disposed within the lock cavity and a locking latch 22 operatively connected to the latch actuation member 21 in a slidably movable manner. The door latch assembly 20 further comprises a rectangular side covering member 23 mounted on a side surface of the door panel at a position which aligns with a latch cavity formed on a door frame wherein the latch actuation member 21 is adapted to be slidably moved to engage and disengage with the door frame through the side covering member 23.

The actuation unit 30 comprises a linking pin 32 and a locking core 31 which has a key slot formed therein and is mounted in the receiving cavity of the front protective housing 11 and operatively connected to the latch actuation member 21 of the locking latch assembly 20 in such a manner that it is capable of actuating the locking latch 22 to slidably move between a locking position and an unlocked position, wherein in the locked position, the locking latch 22 is received in the lock cavity for allowing a pivotal movement of the door panel with respect to the door frame, wherein in the unlocked position, the locking latch 22 is slidably and outwardly extended to engage with the door frame in the latch cavity through the side covering member 23 so that the door panel is being locked up to the door frame by the locking latch 22.

Specifically, the linking pin 32 is rearwardly extended from the locking core 31 and rotatably connected with the latch actuation member 21 and the rear knob frame 12 though a plurality of operation slots formed on the latch actuation member 21 and a front side of the driving member 1221 of the locking rotor 122 respectively, as shown in FIG. 2 of the drawings. According to the preferred embodiment, each of the operation slots is in the shape of a upright 'cross' wherein when a predetermined key is inserted in to the key slot in the locking core 31, the linking pin 32 is adapted to be driven to rotate so as to drive the latch actuation member 21 which then drives the locking latch 22 to move into the locked or unlocked position. Similarly, the locking rotor 122 is adapted to be rotated to a predetermined extent in order to drive the locking latch 22 to the locked or unlocked position by the linking pin 32 which drives the latch actuation member 21.

Referring to FIG. 2 to FIG. 5 of the drawings, the lock enhancing device 40 comprises a reinforcing member 41, which is cylindrical in shape, arranged to be mounted longitudinally in the door panel in the lock cavity so as to fittedly and securely engage therewith. The reinforcing member 41 is preferably made of metallic materials having a predetermined strength capable of resisting a substantial amount of torque applied to it. It is worth mentioning that the exterior shape of the reinforcing member 41 is not necessarily cylindrical. It can be embodied as a column having a cross sectional shape of a square, rectangle, pentagon, or any other shapes.

According to the preferred embodiment, the door lock 1 of the present invention is for use on a door panel having a through circular opening formed thereon to define the lock cavity, wherein the front protective housing 11 and the rear knob frame 12 are mounted on the door panel to sandwich the lock cavity. Accordingly, the circular side boundary defining the circular opening has a predetermined radius of curvature capable of receiving the door latch assembly 20, the actuation unit 30, and the lock enhancing device 40.

The lock enhancing device 40 further comprises a latch guider 42 integrally extended from an inner end of the reinforcing member 41 within the lock cavity between the front protective housing 11 and the rear knob frame 12. The latch guider 42 has an inner rectangular surface 421, an outer convexly curved surface 422, and two side flat surfaces 423 to define a cross sectional shape of a semi-circle, as shown in FIG. 2 of the drawings. Since the latch guider is integrally extended from the reinforcing member 41, accordingly, a radius of curvature of the outer curved surface of the latch guider 42 is made substantially the same as a radius of curvature of the side boundary of the lock cavity so that the reinforcing member 41 and the outer curved surface of the latch guider is fittedly engaged with the door panel.

Figure 3:
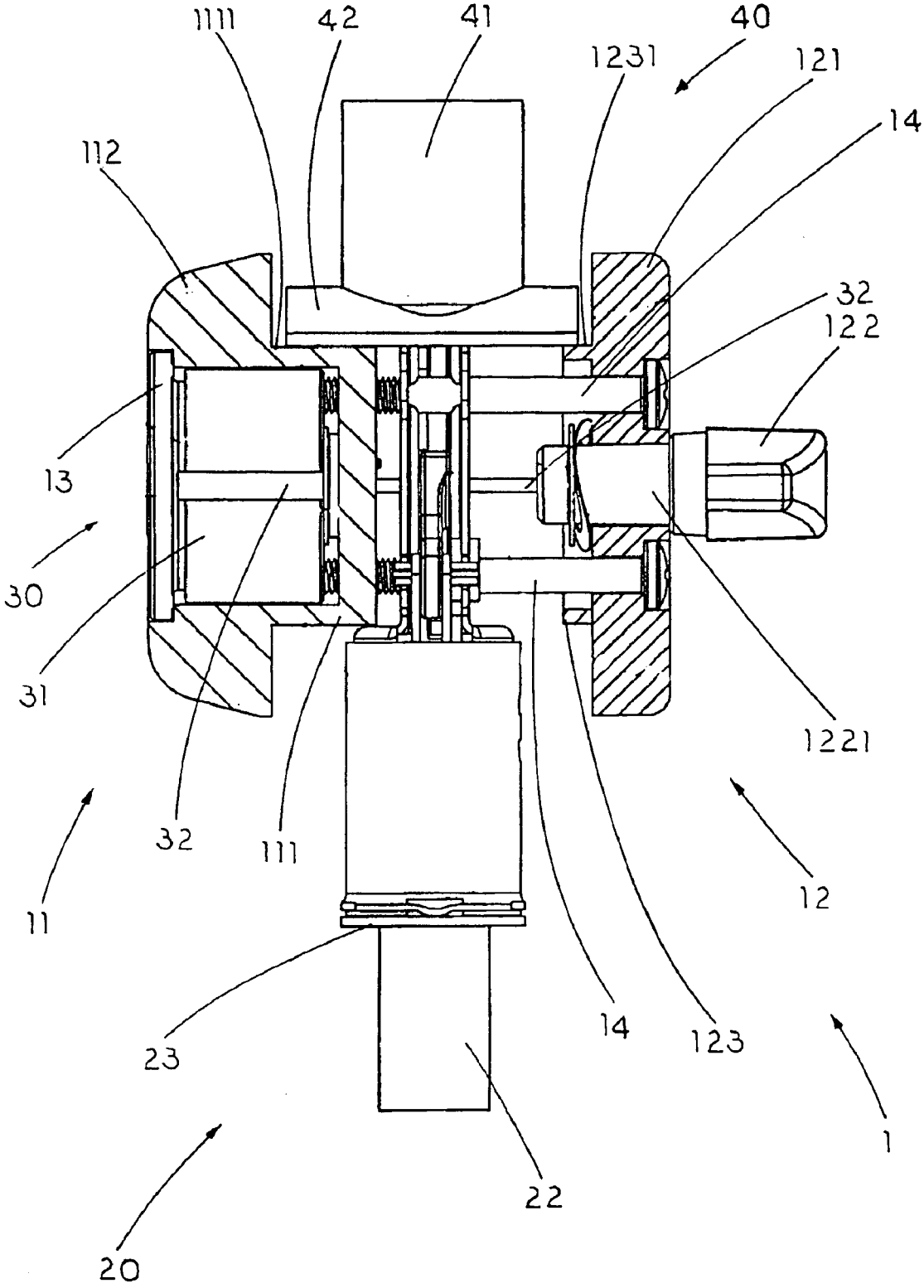
FIG. 3 is a sectional plan view of a door lock with a lock enhancing device according to the above preferred embodiment of the present invention.
Figure 4:
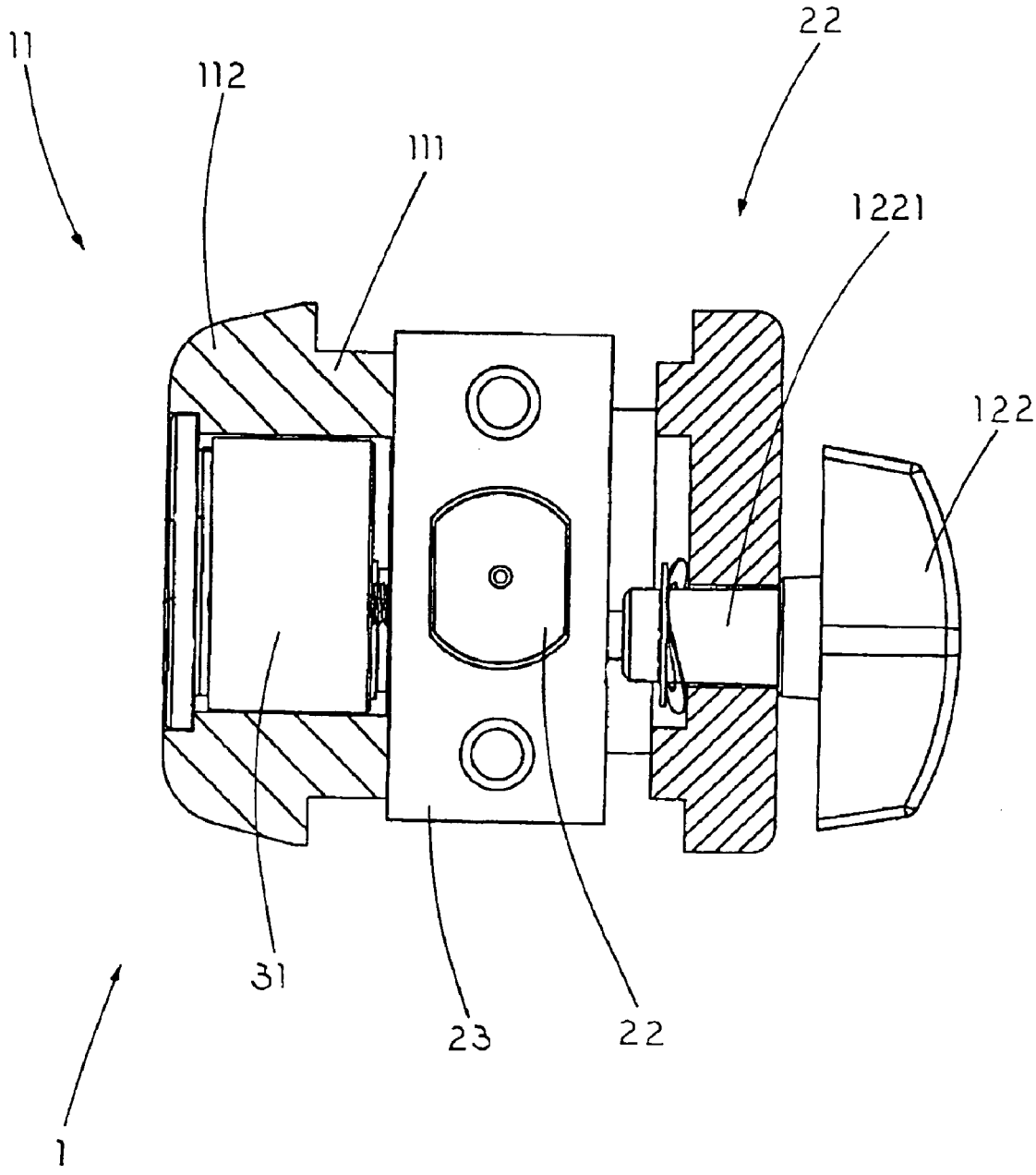
FIG. 4 is a sectional side view of a door lock with a lock enhancing device according to the above preferred embodiment of the present invention.

Furthermore, referring to FIG. 3 of the drawings, the latch guider 42 further has a coupling slot 426 longitudinally formed on the inner surface 421 thereof wherein an inner end portion of the latch actuation member 21 is coupled with the coupling slot 426 in a pivotally movable manner so that a movement of the latch actuation member 21 is substantially restricted by two ends of the coupling slot 426. In other words, when an unusually huge twisting or turning force is applied to the actuation unit 30 with a view to damage the door latch assembly 20, the latch guider 42 effectively provides a restriction of the movement of the latch actuation member 21 so that the door latch assembly 20 is substantially retained in position and prevented from being vigorously driven to break by excessive turning of the locking core 31 of the actuation unit 30.

The latch guider 42 is preferably to be made of strong yet not hard materials so that in discharging its function in preventing excessive movement of the latch actuation member 21, the latch guider 42 will not cause damage to the latch actuation member 21. According to the preferred embodiment, the latch guider 42 should be made of industrial-used plastic materials having a predetermined strength.

In order to provide substantial resistance to damaging impacts and twisting, the rear knob frame 12 further comprises a reinforcing platform 123 frontwardly and integrally extended from the rear doorknob 121 wherein the reinforcing platform 123 has a first reinforcing surface 1231 formed thereon which is adapted to bias against the inner surface 421 of the latch guider 42. The connecting members 14 and the linking pin 32 are then extended through the rear doorknob 121 and the reinforcing platform 123 to reach the front protective housing 11 respectively.

Similarly, the reinforced base 111 has a second reinforcing surface 1111 formed thereon which is adapted to bias against the inner surface 421 of the latch guider 42, as shown in FIG. 3 of the drawings.

In other words, the lock enhancing device 40 is disposed between the front protective housing 11 and the rear knob frame 12 wherein the inner surface 421 of the guider latch 42 is adapted to engage with the first and the second reinforcing surfaces 1231, 1111 by biasing against them.

As a result, when the knob assembly 10 is subject to externally applied damaging impacts or twisting of the actuation unit 30, such twisting forces and impacts are transferred to the latch guider 42 through the door latch assembly 20 which is restricted excessive movement and retained in position by the coupling slot 426. Moreover, the impacts are then transferred to the reinforcing member 41 integrally connected to the latch guider 42 and through the reinforcing member 41 they are transferred to the door panel with which the reinforcing member 41 is engaged. Thus, the externally applied impacts or twisting are capable of being substantially distributed to the to the door panel by the lock enhancing device 40 wherein the strength of the door panel helps in resisting such impacts and twisting.

It is then worth mentioning that the cylindrical exterior shape of the reinforcing member 41 enables maximizing a surface area thereof in order that a maximum amount of external forces can be transferred to the door panel for the provision of maximum reinforcement thereof.

Moreover, when the door lock 1 is subjected to substantial transverse force, both the reinforcing member 41 latched in the door panel and the locking latch 22 which is latched in the door frame take part in resisting such a transverse force.

Equally remarkable is that the latch guider 42 is preferably to be perpendicularly extended from the reinforcing member 41 so as to maximize a resisting torque provided by lock enhancing device when the knob assembly 10 is subjected to externally applied twisting or impact. Other inclination is possible, however, according to the preferred embodiment, the inclination angle is 90 degrees so as to provide the maximum reinforcement to the knob assembly 10.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lock for locking a door panel to a door frame, comprising:

a knob assembly comprising a front protective housing and a rear knob frame adapted for being mounting on a front and a rear side of said door panel respectively so as to define a lock cavity between said front protective housing and said second knob frame;

a door latch assembly comprising a latch actuation member transversely disposed within said lock cavity and a locking latch connected to said latch actuation member in a slidably movable manner;

an actuation unit mounted to said knob assembly to actuate said locking latch to slidably move between a locked position and an unlocked position, wherein in said locked position, said locking latch is received in said lock cavity for allowing a pivotal movement of said door panel with respect to said door frame, wherein in said unlocked position, said locking latch is slidably and outwardly extended for engaging with said door frame so as to lock up with said door frame; and a lock enhancing device, which comprises:

a reinforcing member for substantially mounting to said door panel between said front and said rear side thereof; and a latch guider integrally extended from said reinforcing member within said lock cavity to couple with an inner end portion of said latch actuation member so as to substantially retain said latch actuation member within said lock cavity in position, wherein said latch guider is engaged between said first protective housing and said second knob frame so as to block a rotational movement of each of said first protective housing and said second knob frame with respect to said actuation unit, wherein said latch guider of said lock enhancing device has a coupling slot, having a predetermined length, longitudinally formed on an inner side thereof wherein an inner end portion of said latch actuation member is movably coupled with said coupling slot in such a manner that a movement of said latch actuation member is substantially restricted by two ends of said coupling slot, so that said latch actuation member is retained in position in said lock cavity determined by a longitudinal length of said coupling slot, wherein said latch guider of said lock enhancing device has an inner surface of rectangular cross section, an outer convexly curved surface, and two side flat surfaces to define a semicircular cross sectional shape of said latch guider, wherein a radius of curvature of a said curved outer surface is substantially equal to that of a side boundary of the lock cavity, so that said latch guider is capable of being fittedly and securely engaged with the door panel.

2. The lock, as recited in claim 1, wherein said rear knob frame of said knob assembly comprises a rear door knob adapted to bias against the rear side of the door panel, and a locking rotor, which is rotatably mounted on said rear door knob, and has a driving member extended to couple with said door latch assembly to actuate said locking latch assembly, wherein said rear knob frame further comprises a reinforcing platform which is frontwardly and integrally extended from said rear door knob, and has a first reinforcing surface arranged to bias against said inner surface of said latch guider while said lock enhancing device is sandwiched between said knob assembly.

3. The lock, as recited in claim 2, wherein said front protective housing comprises a reinforced base having a predetermined thickness, and a side boundary peripherally extended therefrom to define a receiving cavity between said reinforced base and said side boundary for receiving said actuation unit, wherein said reinforced base has a second reinforcing surface arranged to bias against said inner surface of said latch guider while said lock enhancing device is sandwiched between said knob assembly.

4. The lock, as recited in claim 3, further having a plurality of aligned operation slots, each having a cross sectional shape of a cross, formed on said latch actuation member and said driving member of said locking rotor, wherein said actuation unit comprises a linking pin rearwardly extended between said actuation unit and said locking rotor through said operation slots in order to actuate said latch actuation member to slidably move in said locked and unlocked positions by rotatably driving said linking pin.

5. The lock, as recited in claim 4, wherein said side boundary has a predetermined thickness which is capable of sustaining a predetermined impact applied thereto without being distorted.

6. The lock, as recited in claim 5, wherein said latch guider is perpendicularly extended from said reinforcing member so as to provide a maximum resisting torque to an external force applied to said knob assembly.

7. The lock, as recited in claim 6, wherein said reinforcing member has a cylindrical exterior shape which is adapted to evenly distribute an externally applied force to said knob assembly to the door panel.

8. The lock, as recited in claim 4, wherein said latch guider is perpendicularly extended from said reinforcing member so as to provide a maximum resisting torque to an external force applied to said knob assembly.

9. The lock, as recited in claim 8, wherein said reinforcing member has a cylindrical exterior shape which is adapted to evenly distribute an externally applied force to said knob assembly to the door panel.

* * * * *